United States Patent [19]

Bernier

[11] Patent Number: 4,934,678

[45] Date of Patent: Jun. 19, 1990

[54] STOP APPARATUS FOR ATTACHING TO GUIDE MEMBERS OF WORKSHIP EQUIPMENT

[76] Inventor: Lucien Bernier, 570 Citation Way, Thousand Oaks, Calif. 91320

[21] Appl. No.: 382,103

[22] Filed: Jul. 19, 1989

[51] Int. Cl.[5] ..... B25B 1/20

[52] U.S. Cl. ..... 269/303

[58] Field of Search ..... 83/468.1–468.9, 83/468, 467.1; 269/303, 304, 305, 315, 236, 98

[56] References Cited

U.S. PATENT DOCUMENTS

| | | | |
|---|---|---|---|
| 1,566,225 | 12/1925 | Mills | 269/315 |
| 2,381,564 | 8/1945 | Taylor | 269/303 |
| 2,680,459 | 6/1954 | Dodson et al. | 269/236 |
| 2,731,989 | 1/1956 | Valcourt et al. | 269/315 |
| 3,348,591 | 10/1967 | Carrasco | 83/468.2 |
| 4,141,542 | 2/1979 | Wolff | 269/98 |
| 4,475,726 | 10/1984 | Smith | 269/236 |

*Primary Examiner*—Robert C. Watson

*Attorney, Agent, or Firm*—Arthur F. Zobal; Geoffrey A. Mantooth

[57] ABSTRACT

A stop apparatus for use in attaching to a guide member of a piece of workship equipment includes a block, a clamp member, and a lever. The block has end and side surfaces and a cavity for receiving the clamp member and the lever. The clamp member has inner and outer portions with the inner portion being actuated by the lever and the outer portion being located exteriorly of the block end surface. A gap for receiving the guide member is formed between the end surface and the clamp member outer portion. The clamp member moves inwardly and outwardly to respectively clamp the apparatus to the guide member and release the apparatus. The lever is provided with an eccentric cam portion and a handle portion. As the lever is pivoted about a shaft by its handle portion, the eccentric cam actuates the clamp member to move inwardly or outwardly. An adjusting screw adjusts the position of the clamp member so that the apparatus can be clamped to fences of various widths. A groove is provided in the bottom surface of the block, for receiving a tape measure, wherein the block can be accurately positioned along the guide member.

16 Claims, 2 Drawing Sheets

STOP APPARATUS FOR ATTACHING TO GUIDE MEMBERS OF WORKSHIP EQUIPMENT

FIELD OF THE INVENTION

The present invention relates to stop apparatuses that releasably attach to projecting guide members on workshop equipment, such as fences on radial arm saws.

BACKGROUND OF THE INVENTION

A radial arm saw has a flat horizontal table for holding the piece of wood stock which is to be cut. The table has a fence or guide that projects above the table and is used to align the wood stock relative to the saw blade. It is frequently desirable to cut the wood stock to an accurate length. Furthermore, it is frequently desirable to accurately cut plural pieces of wood stock to the same length. A stop apparatus for releasably attaching to the fence can be useful in achieving accurate cuts. The stop apparatus is used by locking it onto the fence in the appropriate position. The wood stock is positioned on the table so as to abut against the fence, with one end of the stock abutting against the stop apparatus. With the stock so positioned, the cut can be made. The stop apparatus can be released from the fence for repositioning.

SUMMARY OF THE INVENTION

It is an object of the present invention to provide a stop apparatus for attachment to a guide member of a piece of workshop equipment, such as a fence on a radial arm saw.

The stop apparatus of the present invention includes block means, clamp means, and actuation means. The block means has a side surface and an end surface. The clamp means is adapted for attaching the stop apparatus to the guide member. The clamp means is located in the block means and has an outer portion extending outwardly from the block means end surface. The clamp means outer portion is movable between open and closed positions. The actuation means moves the clamp means outer portion between the open and closed positions. The actuation means is coupled with the clamp means and is movable between first and second positions. The actuation means has a handle portion. The outer portion of the clamp means is spaced apart from the block means end surface so as to form a gap between the end surface and the clamp means outer portion. The gap is adapted to receive the guide member. In the open position of the clamp means outer portion, the outer portion is spaced further away from the end surface of the block means than when the outer portion is in the closed position. The actuation means is moved to the first position to extend the outer portion to the open position to allow the apparatus to be placed on the guide member. The actuation means is moved to the second position to retract the outer portion to the closed position to clamp the apparatus onto the guide member. The actuation means has retaining means for retaining the actuation means in a second position.

In one aspect, the stop apparatus further comprises adjustment means for adjusting the size of the gap between the end surface and the clamp means outer portion independently of the actuation means so as to allow the apparatus to attach to guide members of various thicknesses. The adjustment means is coupled to the clamp means and causes the clamp means outer portion to move with respect to the block means when the adjustment means is adjusted.

In a further aspect, the block means comprises a bottom surface, with the bottom surface having a groove therein for receiving a tape measure. In still a further aspect, the block means has two sides surfaces which are parallel to each other.

DESCRIPTION OF PREFERRED EMBODIMENT

Figure 1:
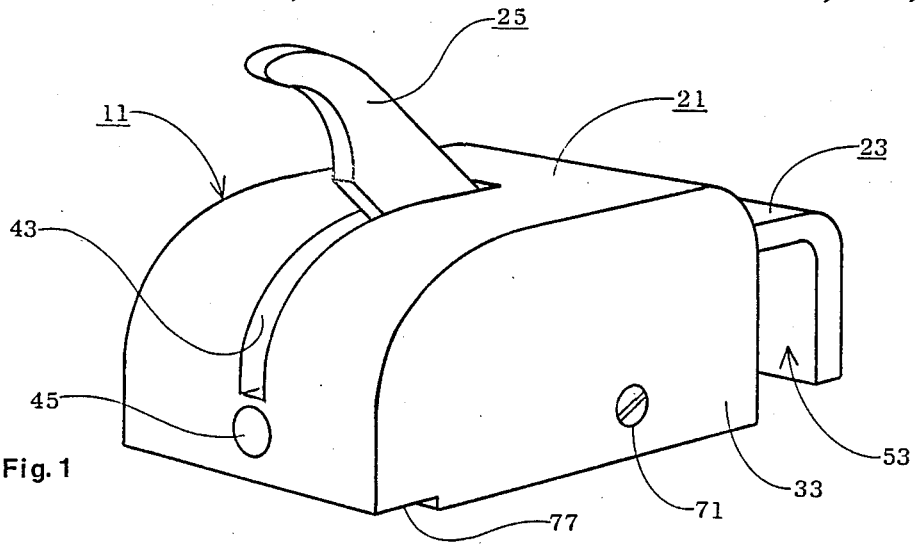
FIG. 1 is an isometric view of the stop apparatus of the present invention in accordance with a preferred embodiment.
Figure 2:
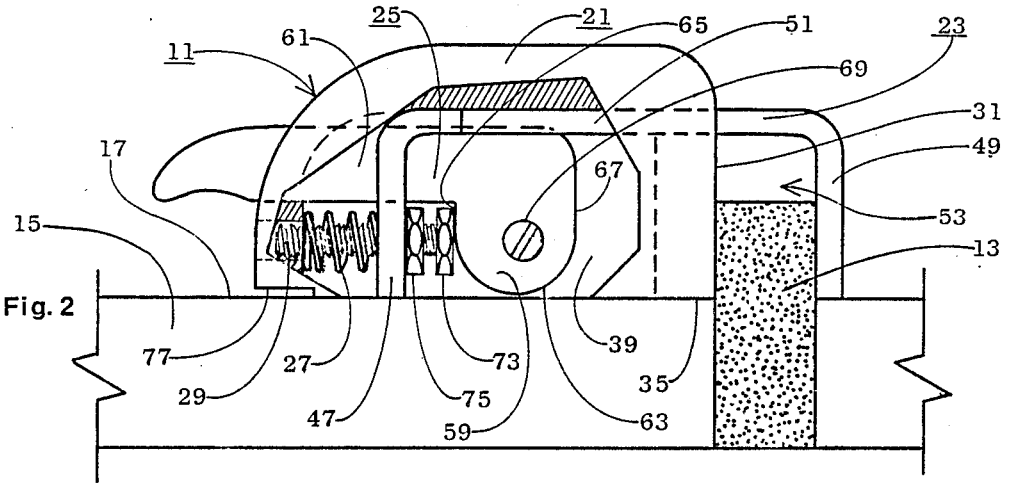
FIG. 2 is a cut away view of the stop apparatus, with the lever shown in the down position and the apparatus shown attached or clamped to a fence.
Figure 5:
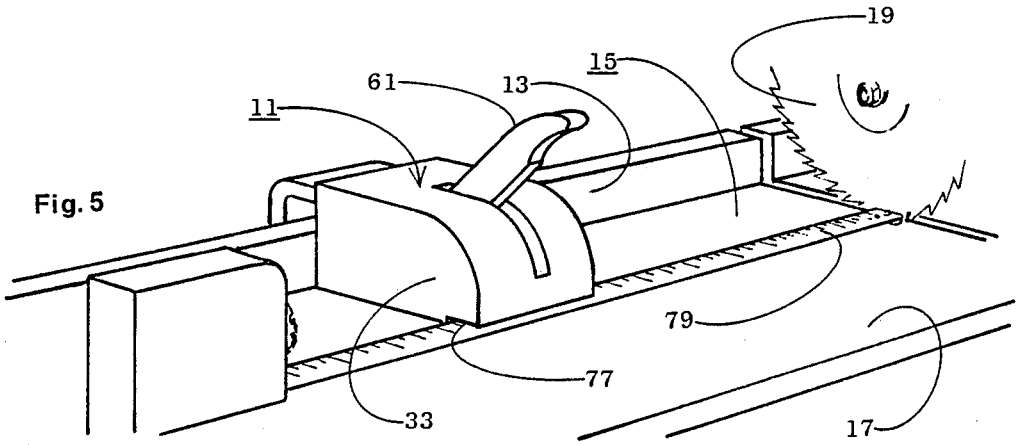
FIG. 5 is an isometric view of the stop apparatus, shown attached to a fence on a radial arm saw, and with a tape measure being received by the groove in the bottom surface of the block.

The stop apparatus 11 of the present invention is used to provide an adjustable stop along guide members 13 on workshop equipment 15. A typical example of a piece of workshop equipment with which the apparatus of the present invention can be used is a radial arm saw 15, portions of which are shown in FIGS. 2 and 5. A radial arm saw has a flat horizontal table 17 for supporting the piece of wood stock (not shown) which is to be cut. The rotating saw blade 19 is pulled in a straight line across the top of the table 17. The table 17 is provided with a fence 13 or guide member which is used to position the wood stock during the cut. The fence 13 projects above the top of the table 17 so as to form a rectangular projection. As will be explained in more detail hereinafter, the apparatus 11 of the present invention is positioned on the fence 13. Typically, one end of the wood stock which is to be cut abuts the stop apparatus. The stop apparatus 11 can be accurately positioned relative to the saw blade 19, wherein the wood stock can be accurately cut by abutting the end of the stock against the stop apparatus.

Referring to the Figures, the stop apparatus 11 includes a block 21, a clamp member 23, a lever 25, a bias spring 27, and an adjusting screw 29.

The block 21, which in the preferred embodiment is made of plastic, has a flat end surface 31, flat side surfaces 33, a flat bottom surface 35, and a top surface 37. The block may also be made of wood or metal. The end surface 31 is perpendicular to the side surfaces 33 and the bottom surface 35, while the side surfaces 33 are parallel to each other. The block 21 has an interior cavity 39 which opens up to the bottom surface for assembly of the interior components. The top surface 37 has a slot 43, extending parallel to the side surfaces 33, for receiving the lever 25. A small circular opening 45 provides access to the interior cavity 39 for the adjusting screw 29.

The clamp member 23 is shaped like an upside down "U". The clamp member 23 has inner and outer portions 47, 49 and a connecting portion 51 between the inner and outer portions. The block 21 has a channel 41 for receiving the connecting portion 51 such that the inner portion 47 is positioned inside of the block cavity 39 and the outer portion 49 is positioned exteriorly of the block. The outer portion 49 is spaced from the block end surface 31 so as to form a gap 53. The clamp member 23 is movable inside of the channel 41. The clamp member 23 moves with respect to the block 21 between inward and outward positions. In the inward position, the gap 53 is small such that the apparatus 11 clamps onto the fence 13. In the outward position, the gap 53 is larger such that the apparatus can be placed on or removed from the fence. The clamp member 23 has a slot 55 for receiving the lever 25. The clamp member 23 also has a threaded opening 57 for receiving the adjusting screw 29.

The lever 25 is a flat plate and has an eccentric cam portion 59 and a handle portion 61. The cam portion 59 is located within the block cavity 39, while the handle portion 61 extends from the cam portion 59, through the slot 55 in the clamp member 23 and the slot 43 in the block 21, to the exterior of the block. The cam portion 59 has an edge 63 that is semicircular in shape. First and second straight edges 65, 67 merge with the semicircular edge 63. The cam portion 59 has an eccentrically located opening 69 for receiving a shaft 71. The distance between the first straight edge 65 and the opening 69 is greater than the distance between the second straight edge 67 and the opening 69. Thus, the cam portion 59 has a thick area at the junction of the edges 63, 65. The cam portion 59 is thinner as the edge 63 is traversed towards the second straight edge 67. The lever 25 pivots about the shaft 71 between up and down positions. The shaft 71 extends across the cavity 39 between the side surfaces 33. The ends of the shaft are received by circular openings in the block 21. The lever 25 is oriented such that the first straight edge 65 is located closer to the clamp member inner portion 47 than is the second straight edge 67.

The adjusting screw 29 is made up of a bolt which has a bolt head 73. The screw 29 is received by the threaded opening 57 of the clamp member 23 such that the bolt head 73 contacts the edges 63, 65 of the cam portion 59. The adjusting screw 29 is threadingly coupled to the clamp member 23. Thus, the cam portion 59 transmits motion to the clamp member 23 through the adjusting screw 29. The shank end of the screw 29, which is slotted to receive a screwdriver, extends into the opening 45 of the block 21. The bias spring 27, which is a coil spring, is located around the adjusting screw 29, between the wall of the block 21 having the opening 45 and the clamp member inner portion 47. The spring 27 exerts force on the clamp member 23 in the outward direction, such that the bolt head 73 maintains contact with the cam portion 59. The adjusting screw 29 is provided with a lock nut 75 adjacent to the bolt head.

Figure 3:
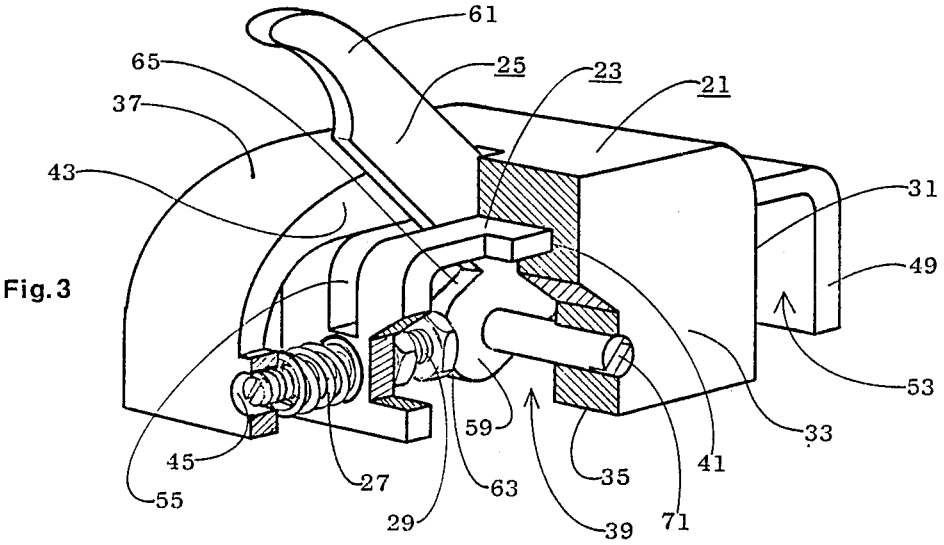
FIG. 3 is a partially cut away isometric view of the stop apparatus, shown with the lever in the up position.
Figure 4:
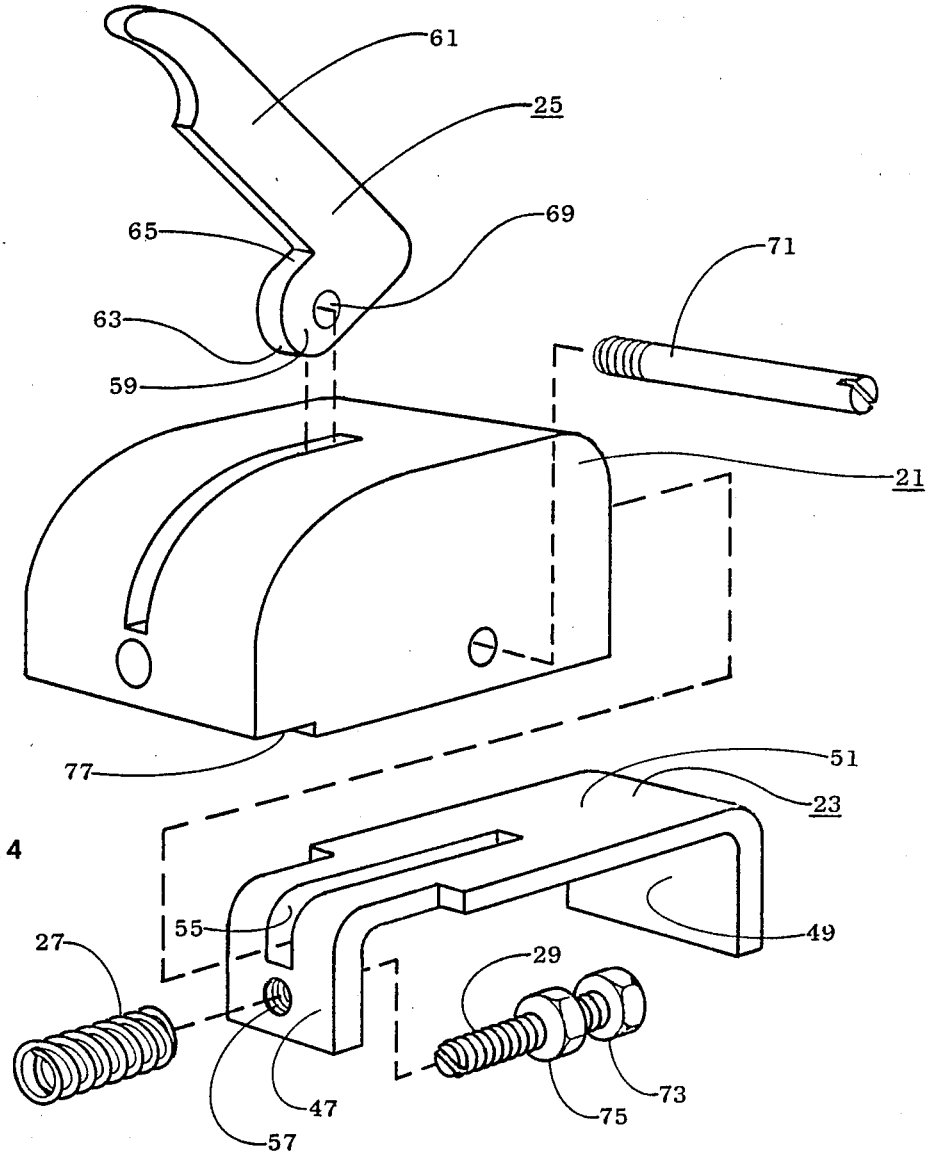
FIG. 4 is an isometric exploded view of the stop apparatus.

The operation of the stop apparatus 11 will now be described. To mount the stop apparatus onto the fence 13, the handle portion 61 of the lever 25 is moved to the up position (as shown in FIG. 3). This presents the thinner area of the cam portion 59 to the adjusting screw 29. The bias spring 27 pushes the clamp member 23 to an outward or open position, wherein the gap 53 between the block end surface 31 and the clamp outer portion 49 is enlarged. In the outward position, the gap 53 is larger than the width of the fence 13, so that the stop apparatus 11 can be placed onto the fence 13 with the fence being received by the gap 53. The end surface 31 abuts the fence 13 and the bottom surface 35 abuts the top surface of the table 17.

The stop apparatus 11 is locked in place on the fence 13 by moving the handle portion 61 of the lever 25 to the down position (as shown in FIG. 2). The cam portion 59 presents the thickest area to the adjusting screw 29, wherein the cam portion 59 pushes the adjusting screw 29 and the clamp member 23 to the inward or closed position. In the inward position, the gap 53 is slightly smaller than the fence width, wherein the apparatus 11 is clamped onto the fence 13.

The lever 25 is retained in the down position by the bolt head 73 contacting the first straight edge 65, instead of the semicircular edge 63. Thus, some amount of force is needed to raise the lever 25. This maintains the apparatus 11 in the clamped configuration even when subjected to vibrations.

When the stop apparatus 11 is clamped onto the fence 13, the side surfaces 33 are perpendicular to the fence. The apparatus can be used as a stop for positioning one end of a board which is to be cut. The apparatus 11 can be used either to the right or the left of the saw blade 19 along the fence 13, wherein the side surface 33 which is closest to the saw blade is used as a stop surface.

The apparatus can easily be repositioned along the fence, by lifting the handle portion 61 of the lever 25 to release the apparatus from the fence. The apparatus can be repositioned by sliding it along the fence, and lowering the lever 25 to reclamp the apparatus.

The bottom surface 35 of the block 21 is provided with a groove 77 extending between the side surfaces 33. The groove 77 can receive a tape measure 79 (see FIG. 5) for accurate positioning of the apparatus along the fence 13.

The inward and outward positions of the clamp member 23 can be adjusted independently of operating the lever 25 by turning the adjusting screw 29 . This adjustment is useful in adjusting the size of the gap 53 so that the apparatus can accommodate various fence widths. To adjust the clamp member 23 position, the adjusting screw 29 is rotated with a screwdriver (not shown) inserted into the opening 45. The adjusting screw 29 is rotated to move the clamp member 23 either further inwardly or further outwardly. As the adjusting screw 29 is rotated, the clamp member 23 moves with respect to the bolt head 73 and the block 21. Thus, as the clamp inner portion 47 is moved further away from the bolt head 73, the size of the gap 53 decreases, wherein the apparatus can be used on narrower fences. Likewise, as the clamp member inner portion 47 is moved closer to the bolt head 73, the size of the gap 53 increases, wherein the apparatus can be used on wider fences. After the desired adjustment is made, the lock nut 75 is positioned so as to abut the clamp member inner portion 47 to maintain the adjustment.

The adjusting screw 29 can alternatively be used to adjust the clamping force with which the apparatus attaches to a fence. If the fence width remains constant, as the clamp member inner portion 47 is moved further away from the bolt head 73 in an inward direction, the size of the gap 53 will decrease, wherein the stop apparatus 11 will clamp more tightly onto the fence 13. Furthermore, the bias spring 27 becomes further compressed, increasing the frictional force between the bolt head 73 and the first straight edge 65. Thus the amount of force which is required to unlock (and lock) the stop apparatus onto the fence is increased, thereby increasing the holding power.

The foregoing disclosure and the showings made in the drawings are merely illustrative of the principles of this invention and are not to be interpreted in a limiting sense.

I claim:

1. A stop apparatus for use in releasably attaching to a projecting guide member of workshop equipment, comprising:

(a) block means having a side surface and an end surface;

(b) clamp means adapted for attaching said stop apparatus to said guide member, said clamp means being located in said block means and having an outer portion extending outwardly from said block means end surface, said clamp means outer portion being movable between open and closed positions;

(c) actuation means for moving said clamp means outer portion between said open and closed positions, said actuation means being coupled with said clamp means and movable between first and second positions, said actuation means having a handle portion;

(d) said outer portion of said clamp means being spaced apart from said block means end surface so as to form a gap between said end surface and said clamp means outer portion, said gap being adapted to receive said guide member;

(e) said clamp means outer portion, when in said open position, being spaced further from said end surface than when said outer portion is in said closed position, wherein when said actuation means is moved to said first position, said outer portion is extended to said open position to allow said apparatus to be placed on said guide member, and when said actuation means is moved to said second position said outer portion is retracted to said closed position to clamp said apparatus onto said guide member;

(f) said actuation means having retaining means for retaining said actuation means in said second position.

2. The stop apparatus of claim 1 further comprising adjustment means for adjusting the size of said gap between said end surface and said clamp means outer portion independently of said actuation means so as to allow said apparatus to attach to guide members to various thicknesses, said adjustment means being coupled to said clamp means and causing said clamp means outer portion to move with respect to said block means when said adjustment means is adjusted.

3. The stop apparatus of claim 2 wherein said block means further comprises a bottom surface, said bottom surface having a groove for receiving a tape measure.

4. The stop apparatus of claim 3 wherein said block means side surface is a first side surface, said block means having a second side surface which is parallel to said first side surface.

5. A stop apparatus for use in releasably attaching to a projecting guide member of workshop equipment, comprising:

(a) block means having a side surface and an end surface which are perpendicular to each other, said block means having an interior cavity;

(b) clamp means adapted for clamping said stop apparatus to said guide member, said clamp means having an outer portion and an inner portion, said outer portion extends outwardly from said block means end surface, said outer portion having an inner surface that faces said block means end surface and is generally parallel to said end surface, said inner portion being located in said block means cavity, said clamp means being movable between inner and outer positions;

(c) biasing means for biasing said clamp means in said outer position, said biasing means being located in said block means cavity and acting against said clamp means inner portion;

(d) actuation means for moving said clamp means between said inner and outer positions, said actuation means having a cam portion located in said block means cavity and a handle portion located exteriorly of said block means, said actuation means cam portion being able to overcome said biasing means to move said clamp means to said inner position when said handle portion is in a first position and allows said biasing means to move said clamp means to said outer position when said handle means is in a second position;

(e) said outer portion of said clamp means being spaced apart from said block means end surface so as to form a gap between said end surface and said clamp means outer portion, said gap being adapted to receive said guide member, said clamp means outer portion, when in said outer position, being spaced further from said block means end surface than when said clamp means outer portion is in said inner position, wherein when said clamp means is in said outer position said apparatus can be placed on said guide member and when said clamp means is in said inner position, said apparatus can be clamped to said guide member;

(f) said actuating means having retaining means for retaining said actuating means in said first position.

6. The apparatus of claim 5 further comprising adjustment means for adjusting the size of said gap between said end surface and said clamp means outer portion independently of said actuation means so as to allow said apparatus to attach to guide members of various thicknesses, said adjustment means coupled to said clamp means inner portion and causing said clamp means to move further inwardly or outwardly when adjusted.

7. The apparatus of claim 6 wherein said clamp means comprises an inverted U-shaped member, wherein said inner and outer portions are parallel to each other and are connected to each other with a connecting portion.

8. The apparatus of claim 6 wherein said adjustment means comprises a screw having one end that contacts said actuation means cam portion, said screw being coupled to said clamp means such that when said screw is turned said clamp means moves with respect to said block means.

9. The apparatus of claim 8 wherein said retaining means comprises a flat surface on said actuation means cam portion, said screw contacting said flat surface when said actuation means is in said first position.

10. The stop apparatus of claim 5 wherein said block means further comprises a bottom surface, said bottom surface having a groove for receiving a tape measure.

11. The stop apparatus of claim 10 wherein said block means side surface is a first side surface, said block means having a second side surface which is parallel to said first side surface.

12. The apparatus of claim 6, wherein:

(a) said block means further comprises a bottom surface, said bottom surface having a groove for receiving a tape measure;

(b) said block means side surface is a first side surface, said block means having a second side surface which is parallel to said first side surface;

(c) said clamp means comprises an inverted U-shaped member, wherein said inner and outer portions are parallel to each other and are connected to each other with a connecting portion;

(d) said adjustment means comprises a screw having one end that contacts said actuation means cam portion, said screw being coupled to said clamp means such that when said screw is turned said clamp means moves with respect to said block means;

(e) said retaining means comprises a flat surface on said actuation means cam portion, said screw contacting said flat surface when said actuation means is in said first position.

13. The apparatus of claim 6, wherein:

(a) said handle portion of said actuation means is generally transverse to said cam portion;

(b) a pivot pin supported by said block means extends through said cam portion, wherein said handle portion and said cam portion can pivot about said pin, with said handle portion being movable between a downward position and an upper position defining said first and second positions generally;

(c) said adjustment means comprises a screw having one end that engages said cam portion, said screw being threadingly received by a threaded opening in said clamp means inner portion;

(d) said biasing means comprises a coil spring located around said adjustment means screw and between said block means and said clamp means inner portion so as to provide force against said clamp means inner portion in the outer direction, wherein as said screw is rotated, said clamp means inner portion moves inwardly or outwardly.

14. The apparatus of claim 12, wherein:

(a) said handle portion of said actuation means is generally transverse to said cam portion;

(b) a pivot pin supported by said block means extends through said cam portion, wherein said handle portion and said cam portion can pivot about said pin, with said handle portion being movable between a downward position and an upper position defining said first and second positions generally;

(c) said adjustment means comprises a screw having one end that engages said cam portion, said screw being threadingly received by a threaded opening in said clamp means inner portion;

(d) said biasing means comprises a coil spring located around said adjustment means screw and between said block means and said clamp means inner portion so as to provide force against said clamp means inner portion in the outer direction, wherein as said screw is rotated, said clamp means inner portion moves inwardly or outwardly.

15. A stop apparatus, comprising:

(a) a first member having parallel side surfaces, a bottom surface, and an end surface;

(b) a second member comprising an inverted Ushaped bracket with first and second ends, said second member being received by said first member such that said first end of said second member bracket is spaced apart from said first member end surface so as to form a gap between said end surface and said first end, said second member being movable relative to said first member such that said gap can be made smaller or larger;

(c) lever means for moving said second member first end relative to said first member, said lever means being pivotable relative to said first member, said lever means having a cam portion that is received by said first member, said cam portion being coactingly engaged with said second member second end such that as said cam portion rotates, said second member moves, said lever means having an arm extending from said cam portion out from said first member;

(d) biasing means for biasing said second member in a position relative to said first member, said cam portion overcoming said biasing means to move second member, said biasing means comprising a coil spring;

(e) said cam portion having a flat surface that coactingly engages said second member second end when said gap is small, said flat surface serving to releasably maintain said second member in position relative to said first member.

16. The apparatus of claim 15 further comprising an adjusting screw that coactingly engages said second member, said adjusting screw adjusting the size of said gap independently of said lever means.

* * * * *